US005613505A

United States Patent [19]

Campbell et al.

[11] Patent Number: 5,613,505

[45] Date of Patent: Mar. 25, 1997

[54] INDUCTIVE HEATING SYSTEMS FOR SMOKING ARTICLES

[75] Inventors: John M. Campbell; Grier S. Fleischhauer, both of Midlothian; Charles T. Higgins, Richmond; Robert L. Ripley, Midlothian; David E. Sharpe, Chesterfield; Michael L. Watkins, Chester; Susan E. Wrenn, Chesterfield, all of Va.

[73] Assignee: Philip Morris Incorporated, New York, N.Y.

[21] Appl. No.: 225,120

[22] Filed: Apr. 8, 1994

Related U.S. Application Data

[63] Continuation-in-part of Ser. No. 105,346, Aug. 10, 1993, Pat. No. 5,479,948, and a continuation-in-part of Ser. No. 118,665, Sep. 10, 1993, Pat. No. 5,388,594, and a continuation-in-part of Ser. No. 943,504, Sep. 11, 1992, Pat. No. 5,505,214.

[51] Int. Cl.[6] ..... A24F 47/00

[52] U.S. Cl. ..... 131/194; 128/203.27; 128/203.21; 219/600

[58] Field of Search ..... 131/194, 270, 131/273; 128/203.27, 202.21; 219/600, 606

[56] References Cited

U.S. PATENT DOCUMENTS

| | | |
|---|---|---|
| 3,443,049 | 5/1969 | Hoagland . |
| 3,976,529 | 8/1976 | Weichselbaum . |
| 4,103,144 | 7/1978 | Pizzarello . |
| 4,355,222 | 10/1982 | Geithman et al. . |
| 4,467,165 | 8/1984 | Kiuchi . |
| 4,488,335 | 12/1984 | Fox . |
| 4,521,659 | 6/1985 | Buckley . |
| 4,765,859 | 8/1988 | Heath et al. . |
| 4,789,767 | 12/1988 | Doljack . |
| 5,060,671 | 10/1991 | Counts et al. . |
| 5,075,529 | 12/1991 | Kudo . |
| 5,101,086 | 3/1992 | Dion et al. . |
| 5,236,108 | 8/1993 | House . |

FOREIGN PATENT DOCUMENTS

| | | |
|---|---|---|
| 1060598A | 4/1992 | China . |
| 0239802A2 | 10/1987 | European Pat. Off. . |
| 0378997 | 4/1990 | European Pat. Off. . |
| 449790A2 | 10/1991 | European Pat. Off. . |

(List continued on next page.)

OTHER PUBLICATIONS

Brezovich, "Temperature Distributions in Tumor Models Heater." Mar./Apr. 1984, pp. 145–152.

Duarte, "A Design Procedure For a Self Oscillating Hybrid Inverter." 1991, pp. 350–355.

Gorbachev, "Compensation Of Varying Load In A Thyristor." v. 56, No. 3, pp. 27–28.

Katagiri, "Rapid Reinforcement For Fusion Mass Spliced Fibers Using Low–Power." Jun. 1, 1985, pp. 1708–1712.

Matthes, "Thyristorised Converters For Inductive Heating For Hot Forging." 1975, pp. 80–86.

Mioduszewski, "Inductive Heating Of Spent Granular Activated Carbon." Mar. 1982, pp. 1–96.

Stauffer, "Observations On The Use Of Ferromagnetic." 1984. pp. 76–90.

Xu, "The High–Frequency Inductive Electric Heater And Its Application." Apr. 1992, pp. 39–42.

*Primary Examiner*—Jennifer Bahr

*Attorney, Agent, or Firm*—James T. Moore; James E. Schardt; Charles E. B. Glenn

[57] ABSTRACT

An induction heating source is provided for use with an electrical smoking article. The induction heating source provides an alternating electromagnetic field which inductively heats a susceptor in thermal proximity with tobacco flavor medium to generate aerosols. A plurality of induction heaters are employed and/or the tobacco flavor medium is translated with respect to the induction heater or susceptor. The tobacco flavor medium can form an intimate structure with the susceptor and can take the form of a cylindrical cigarette or a web.

42 Claims, 18 Drawing Sheets

FOREIGN PATENT DOCUMENTS

| | | |
|---|---|---|
| 0640297A1 | 1/1995 | European Pat. Off. . |
| 243784A1 | 11/1987 | German Dem. Rep. . |
| 3711234 | 10/1988 | German Dem. Rep. . |
| 301092A7 | 1/1992 | German Dem. Rep. . |
| 2911565 | 9/1980 | Germany . |
| 3038069A1 | 4/1982 | Germany . |
| 3735704A1 | 10/1987 | Germany . |
| 45-28471 | 9/1970 | Japan . |
| 2-98301 | 4/1990 | Japan . |
| 2-263773 | 10/1990 | Japan . |
| 621141 | 8/1978 | U.S.S.R. . |
| 864597 | 9/1981 | U.S.S.R. . |
| WO94/06313 | 3/1994 | WIPO . |
| WO94/06314 | 3/1994 | WIPO . |

A – A

INDUCTIVE HEATING SYSTEMS FOR SMOKING ARTICLES

CROSS-RELATED APPLICATIONS

The present application is a continuation-in-part of commonly assigned U.S. patent application Ser. No. 08/105,346, filed Aug. 10, 1993, now U.S. Pat. No. 5,479,948, issued Jan. 2, 1996, and U.S. patent application Ser. No. 08/118,665, filed Sep. 10, 1993, now U.S. Pat. No. 5,388,594, issued Feb. 14, 1995, and to its parent U.S. patent application Ser. No. 07/943,504, filed Sep. 11, 1992, now U.S. Pat. No. 5,505,214, issued Apr. 9, 1996, which are hereby incorporated by reference.

BACKGROUND OF THE INVENTION

1. Technical Field of the Invention

The present invention relates generally to heating systems for electrically powered smoking articles and more particularly to inductive heating systems for electrically powered smoking articles.

2. Discussion of the Related Art

Previously known more conventional smoking devices deliver flavor and aroma to the user as a result of combustion. A mass of combustible material, primarily tobacco, is combusted and adjacent portion of material is pyrolized as the result of applied heat drawn therethrough, with typical combustion temperatures in a more conventional cigarette being in excess of 800° C. during puffing. During this heating, inefficient oxidation of the combustible material takes place and yields various distillation and pyrolysis products. As these products are drawn through the body of the smoking device toward the mouth of the user, they cool and condense to form an aerosol or vapor which gives the consumer the flavor and aroma associated with smoking.

Conventional cigarettes have various perceived drawbacks associated with them. Among them is the production of sidestream smoke during smoldering between puffs, which may be objectionable to some non-smokers. Also, once lit, they must be fully consumed or be discarded. Relighting a conventional cigarette is possible but is usually an unattractive prospect for subjective reasons (flavor, taste, odor) to a discerning smoker.

A prior alternative to the more conventional cigarettes include those in which the combustible material itself does not directly provide the flavorants to the aerosol inhaled by the smoker. In these smoking articles, a combustible heating element, typically carbonaceous in nature, is combusted to heat air as it is drawn over the heating element and through a zone which contains heat-activated elements that release a flavored aerosol. While this type of smoking device produces little or no sidestream smoke, it still generates products of combustion, and once lit it is not adapted to be snuffed for future use in the conventional sense.

Commonly assigned U.S. Pat. Nos. 5,093,894; 5,225,498; 5,060,671 and 5,095,921 disclose various heating elements and flavor generating articles which significantly reduce sidestream smoke while permitting the smoker to selectively suspend and reinitiate smoking. However, the cigarette articles disclosed in these patents are not very durable and may collapse, tear or break from extended or heavy handling. In certain circumstances, these prior cigarette articles may crush as they are inserted into the electric lighters. Once they are smoked, they are even weaker and may tear or break as they are removed from the lighter.

U.S. patent application Ser. No. 08/118,665, filed Sep. 10, 1993, describes an electrical smoking system including a novel electrically powered lighter and novel cigarette that is adapted to cooperate with the lighter. The preferred embodiment of the lighter includes a plurality of metallic sinusoidal heaters disposed in a configuration that receives, via insertion, a tobacco rod portion of the cigarette.

The preferred embodiment of the cigarette of Ser. No. 08/118,665 preferably comprises a tobacco-laden tubular carrier, cigarette paper overwrapped about the tubular carrier, an arrangement of flow-through filter plugs at a mouthpiece end of the carrier and a filter plug at the opposite (distal) end of the carrier, which preferably limits air flow axially through the cigarette. The cigarette and the lighter are configured such that when the cigarette is inserted into the lighter and as individual heaters are activated for each puff, localized charring occurs at spots about the cigarette in the locality where each heater was bearing against the cigarette. Once all the heaters have been activated, these charred spots are closely spaced from one another and encircle a central portion of the carrier portion of the cigarette. Depending on the maximum temperatures and total energies delivered at the heaters, the charred spots manifest more than mere discolorations of the cigarette paper. In most applications, the charring will create at least minute breaks in the cigarette paper and the underlying carrier material, which breaks tends to mechanically weaken the cigarette. For the cigarette to be withdrawn from the lighter, the charred spots must be at least partially slid past the heaters. In aggravated circumstances, such as when the cigarette is wet or toyed with or twisted, the cigarette may be prone to break or leave pieces upon its withdrawal from the lighter. Pieces left in the lighter fixture can interfere with the proper operation of the lighter and/or deliver an off-taste to the smoke of the next cigarette. If the cigarette breaks in two while being withdrawn, the smoker may be faced not only with the frustration of failed cigarette product, but also with the prospect of clearing debris from a clogged lighter before he or she can enjoy another cigarette.

The preferred embodiment of the cigarette of Ser. No. 08/118,665 is essentially a hollow tube between the filter plugs at the mouthpiece end of the cigarette and the plug at the distal end. This construction is believed to elevate delivery to the smoker by providing sufficient space into which aerosol can evolve off the carrier with minimal impingement and condensation of the aerosol on any nearby surfaces. However, the hollow construction is susceptible to being bent or folded, crushed, collapsed and/or torn through handling. The structure also is vulnerable to damage during cigarette making and packing, particularly in modern, high speed cigarette making and packing machines.

It is desirable to reduce or eliminate the need for contact between the tobacco flavor medium, and any associated structure, and relatively fragile heating elements to minimize disruption or termination of the heating system as the numerous tobacco medium products are inserted, adjusted during use, and removed. It is also important to provide uniform heat for successive firings of a smoking article. Also, heating systems which require thermal contact or close thermal registry between heater elements and the tobacco flavor medium necessitate precise manufacturing tolerances which may be difficult or economically unfeasible to achieve and/or maintain at high mass production rates. In addition, it is always desirable to improve the heating efficiency of heating systems, thereby reducing power consumption of the smoking article and the mass of the power source. Further, conductive and/or convective heating of a tobacco flavor medium wrapped in paper or embedded in a paper matrix necessitates burning through the paper, releasing paper-derived vapors in addition to desired aerosols from the tobacco flavor medium, which could condense on relatively cooler components such as sensitive electronics, causing shorts or other undesired degradations and/or malfunctions.

Commonly owned U.S. Pat. No. 5,060,171, issued Oct. 29, 1991, at col. 10, lines 1–7, discloses coupling energy to a flavor generating article by magnetic or electromagnetic induction followed by suitable recertification and conditioning prior to charging a capacitor which powers the heater.

OBJECTS OF THE INVENTION

It is accordingly an object of the present invention to reduce or eliminate contact between the tobacco flavor medium and a heating source to increase interspatial tolerances therebetween.

it is another object of the present invention to reduce or eliminate a requirement for thermal contact or close thermal registry between the tobacco flavor medium and a heating source.

It is a further object of the present invention to reduce precise manufacturing tolerances for the tobacco flavor medium and a smoking article.

It is another object of the present invention to provide a heating system for a smoking article having a desired power consumption.

It is a further object of the present invention to provide relatively uniform heat to the tobacco flavor medium during successive activations of a smoking article.

It is another object of the present invention to avoid heating through paper or other materials to heat the tobacco flavor medium.

It is a further object of the present invention to reduce condensation.

Additional objects and advantages of the present invention are apparent from the drawings and the following specification.

SUMMARY OF THE INVENTION

The foregoing and additional objects are attained by the present invention. An induction source produces an alternating electromagnetic (EM)field which induces a heat generating eddy current in a susceptor. This heated susceptor in turn heats tobacco flavor medium located in thermal proximity thereto.

In one embodiment of the present invention, a plurality of induction sources are located circumferentially around a cylinder of tobacco flavor medium. The susceptor is either located within a layer of tobacco flavor medium or is layered with the tobacco flavor medium to form a laminate. Alternatively, a single induction source and cylinder are translated axially relative to one another. Alternatively, a movable substrate containing tobacco flavor medium, e.g., a web, is registered with a relatively stationary induction source. The induction source either inductively heats susceptor materials mixed with or layered on the tobacco flavor medium or inductively heats a distinct susceptor element in thermal proximity to the tobacco flavor medium.

DETAILED DESCRIPTION OF THE PREFERRED EMBODIMENTS

Induction heating is a known phenomenon described by Faraday's law of induction and Ohm's law. More specifically, Faraday's law of induction states that if the magnetic induction β in a conductor is changing, a changing electric field E is produced in the conductor. Since this electric field E is produced in a conductor, a current, known as an eddy current, will flow in the conductor according to Ohm's law. The eddy current will generate heat proportional to the current density and the conductor resistivity. A conductor which is capable of being inductively heated is known as a susceptor. The present invention employs an inductive heating source which generates an alternating magnetic field β from an AC source such as an LC circuit. More specifically, an EM field is produced. The produced field will be referred to as a magnetic field since this component is believed to be the agent of the induction heating of the susceptor. Heat generating eddy currents are then generated in a susceptor which is either part of the tobacco flavor medium delivery system or a distinct element in thermal proximity thereto. The primary heat transfer mechanisms for the susceptor to the tobacco medium are, in order of effect, conduction, radiation and possibly convection. Conduction is the primary heat transfer mechanism.

The tobacco flavor medium used in the present invention is defined in greater detail in the parent and related applications and comprises tobacco, reconstituted tobacco, combinations thereof, etc., which can be heated to evolve desired flavors. An eddy current can not be induced in such tobacco flavor medium because tobacco is considered a dielectric. More specifically, tobacco has a high specific resistivity and low magnetic permeability. Accordingly, a susceptor is employed which is in thermal proximity with the tobacco flavor medium, i.e., the susceptor is positioned relative to the tobacco flavor medium to transfer an adequate amount of heat to the tobacco flavor medium to evolve the desired flavors. For example, the susceptor can be a distinct element which is close enough to the tobacco flavor medium to transfer heat thereto, a layer of susceptor material in thermal proximity to the tobacco flavor medium, or a discontinuous susceptor material layered on, interspersed in, or surrounded by the tobacco flavor medium, as described below.

Figure 1:
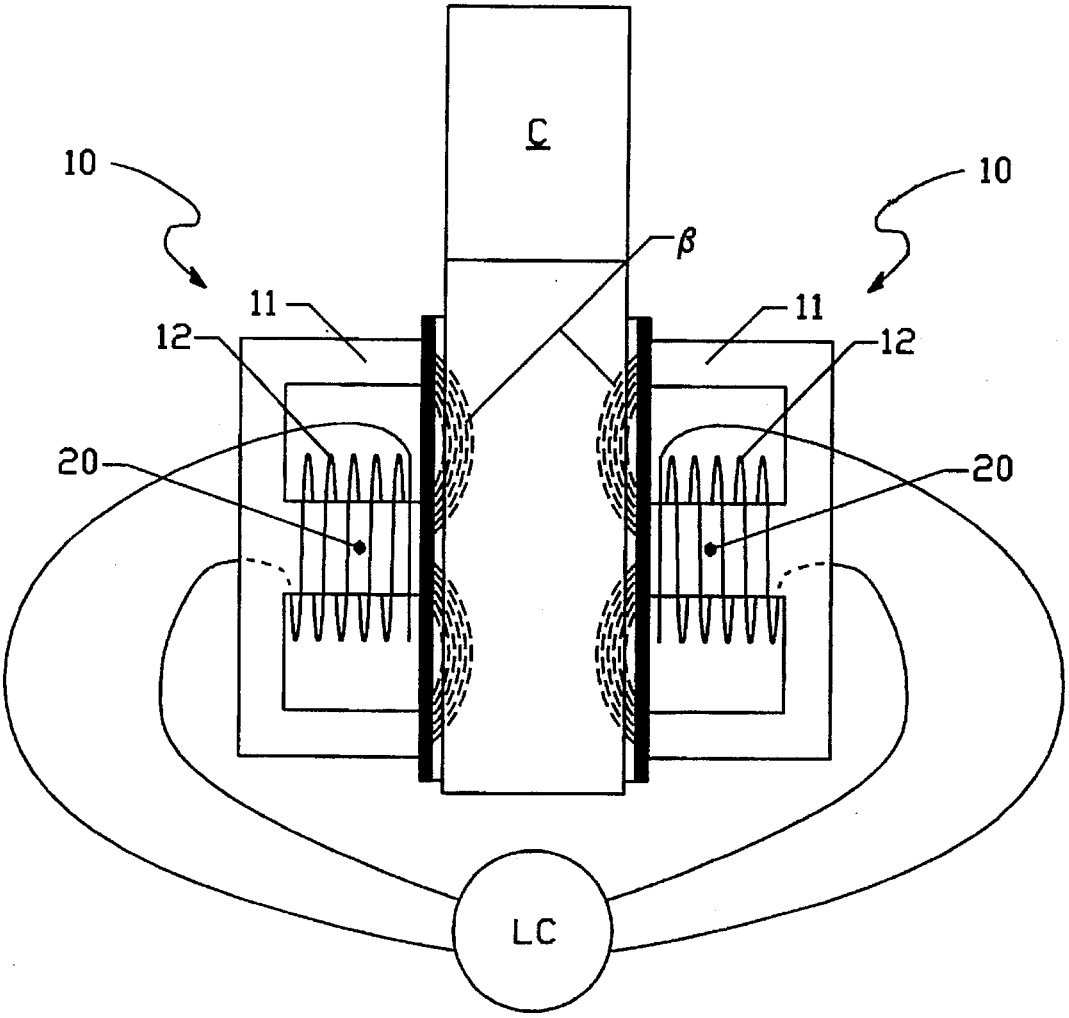
FIG. 1 is an exposed side view of E-shaped induction heating source shown in conjunction with a cylindrically shaped tobacco flavor medium or cigarette according to the present invention.
Figure 2:
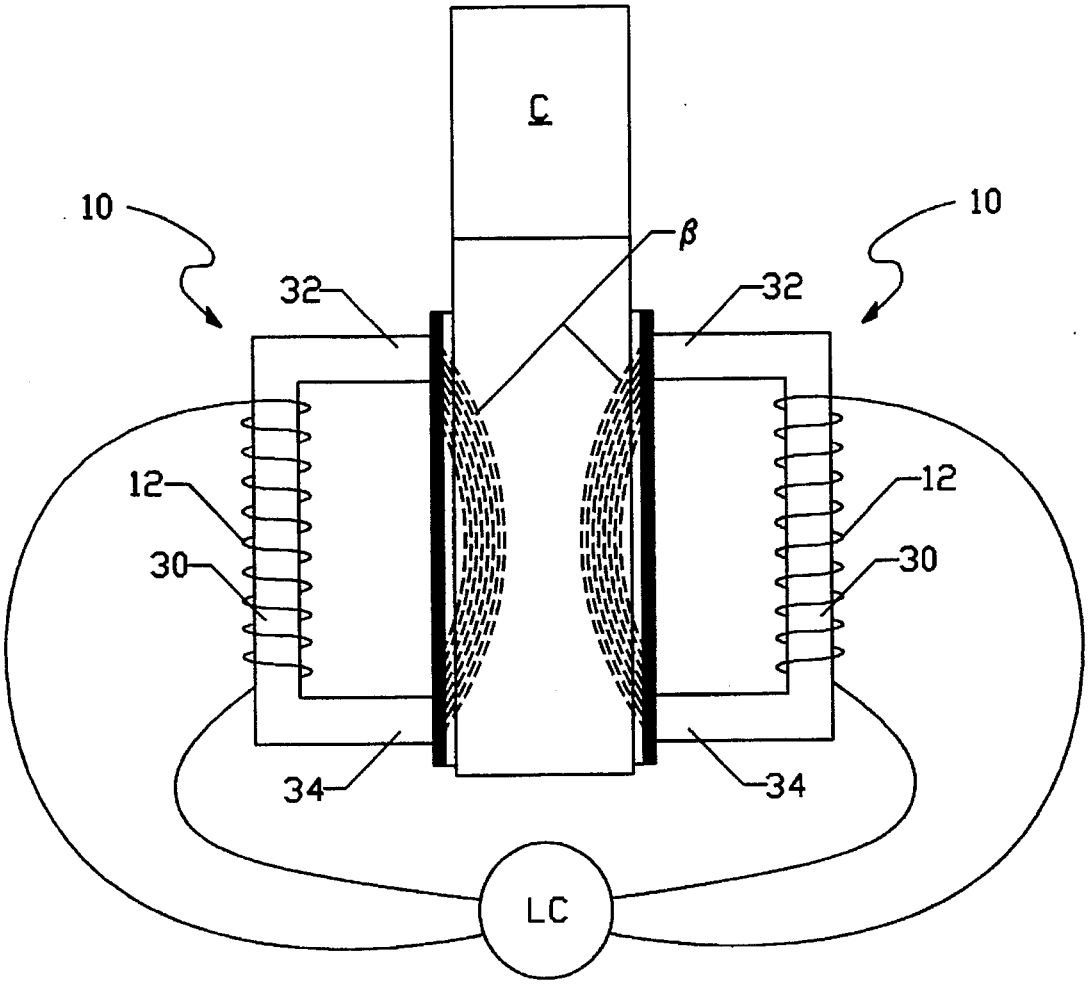
FIG. 2 is an exposed side view of C-shaped induction heating source shown in conjunction with a cylindrically shaped tobacco medium or cigarette according to the present invention.

For example, as shown in FIGS. 1 and 2, the induction heating source 10 may comprise an appropriately shaped pole piece 11 composed of ferrite or other magnetically permeable material having a current bearing wire or excitation coil 12 wrapped around a portion thereof to form a toroid. The current bearing wire 12 is connected to an alternating current circuit 14. The induction source 10 may be shaped as an E, as shown in FIG. 1, with the wire 12 spiraled around the center leg 20 located between, and extending in the same direction as, two end legs or as a squared C, as shown in FIG. 2, with the wire 12 spiraled along the middle section 30 between the two perpendicularly extending legs 32 and 34. Alternatively, the pole piece comprises a rod encircled by an excitation coil. The circuit may be any appropriate circuit LC connected to a battery or other source of electrical power, as discussed in greater detail below. The induction heating source will accordingly form an alternating magnetic field. In the case of the E-shaped pole piece of FIG. 1, the magnetic field β lines will extend from the center leg to each respective end leg, forming two respective arcs composed of a plurality of field lines. Accordingly, the magnetic field is self sealing between the legs. In the case of C-shape pole piece of FIG. 2, the magnetic field lines will extend between the end legs in an arc comprising a plurality of field lines and is self-sealed. This generated alternating magnetic field will induce eddy currents within appropriately positioned susceptors, as discussed below.

Figure 3:
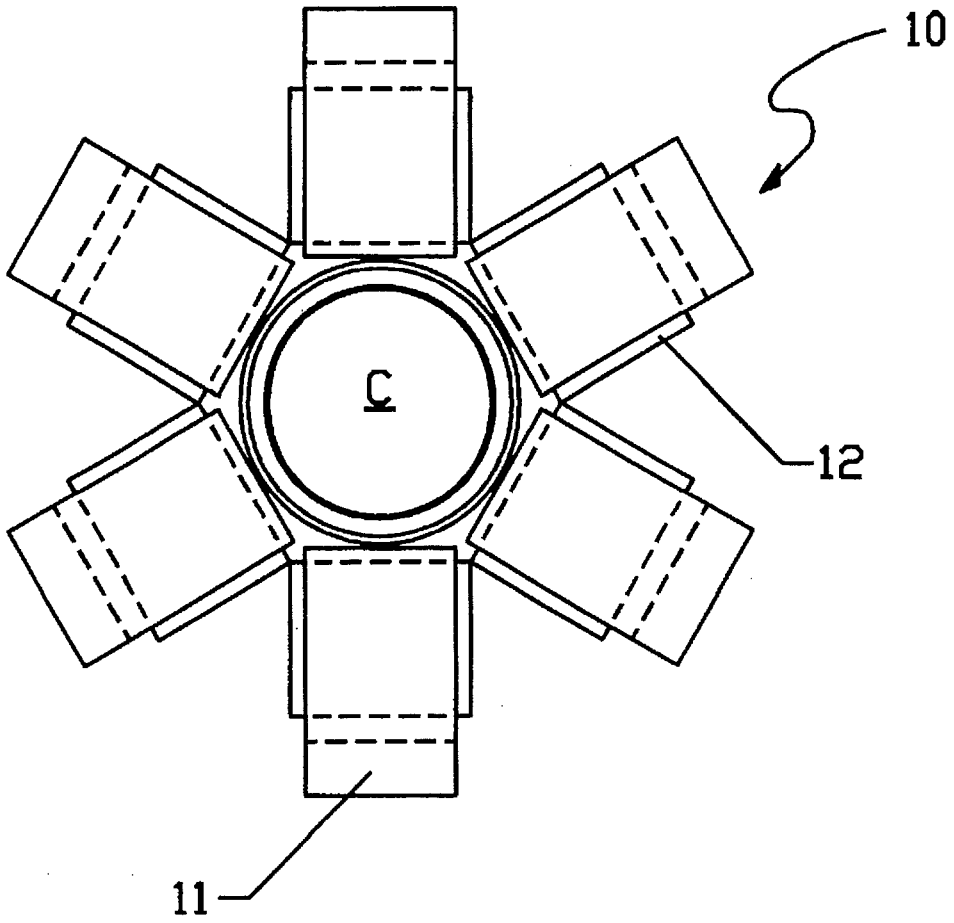
FIG. 3 is a top view of induction heating sources according to the present invention shown in conjunction with a cylindrically shaped tobacco flavor medium or cigarette.

As best seen in FIG. 3, in one embodiment a plurality of induction sources 10 are employed and arranged circumferentially around the cylindrical cigarette C, comprised of tobacco flavor medium, in a substantially planar relationship. Although six induction sources 10 are shown in FIG. 3, the preferred number of induction sources in this embodiment is equal to the desired number of puffs to be generated by heating the cigarette, e.g., six, seven, eight, nine or more. Each induction source is configured to generate an alternating magnetic field in response to a signal indicating that the smoker is drawing on the article. The respective firings of an inductive source can be in a sequential order around the circumference or in any other desired pattern, such as firing a first induction source, followed by the oppositely located induction source, followed by the induction source next to the first source, and so forth, to minimize undesired heat transfer to portions the cigarette which are not intended to be heated, i.e., non-"target" areas. As a result, longitudinally extending portions of the tube of tobacco flavor medium are heated evenly around the tube. In an alternative embodiment, the circumferentially arranged induction sources 10 can be staggered relative to longitudinal axis of the cigarette. For example, the induction sources 10 can be spiraled around to the cigarette. As a result, staggered, longitudinally extending portions of the tube of tobacco flavor medium are heated.

Figure 4:
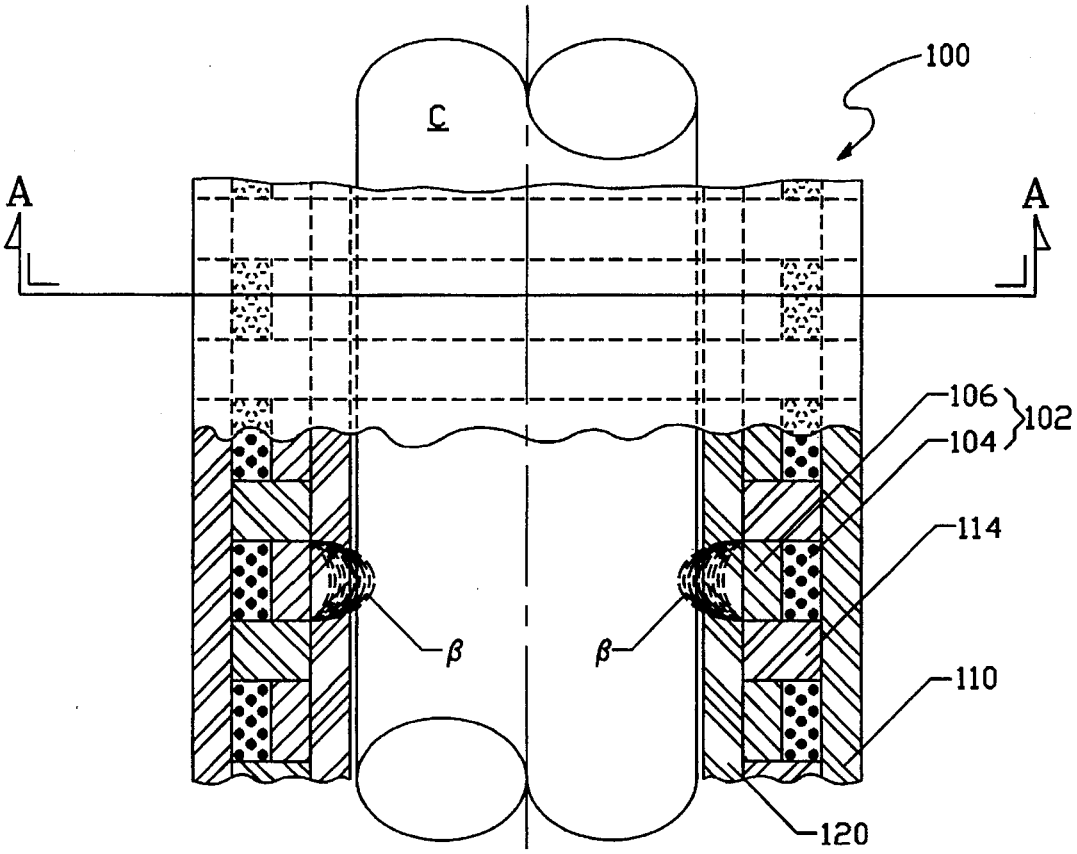
FIG. 4 is an exposed side view of a cylindrical induction heating source according to the present invention comprising a plurality of generally circular induction heating sources.
Figure 5:
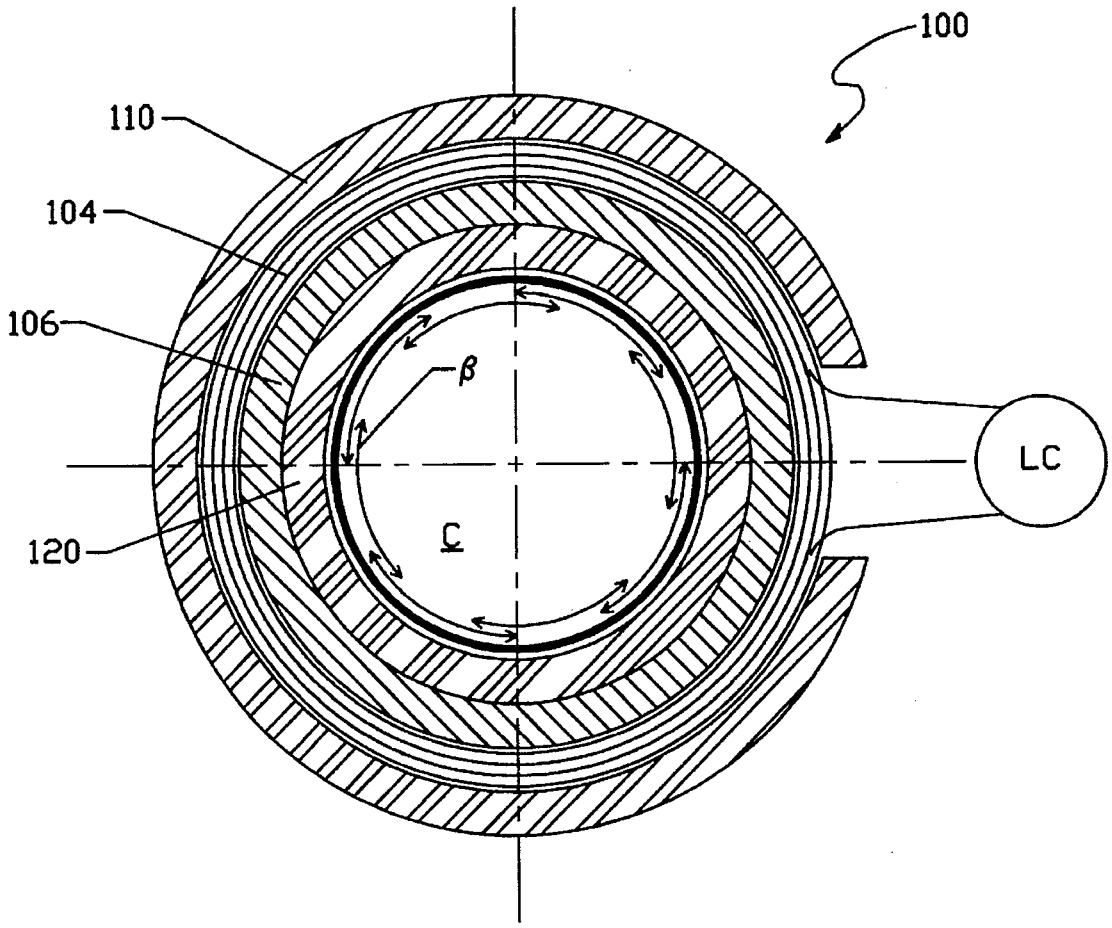
FIG. 5 is an exposed front view taken along line A—A of FIG. 4.

Another embodiment of the induction source is shown in FIGS. 4 and 5. Cylindrical induction source 100 comprises a plurality of individual, generally circular induction sources 102 separated and magnetically insulated from one another by respective annular shields 114. An outer shield 110 can be a split stainless steel magnetic collar encircling all of the induction sources 102 and the plurality of distinct shield rings 114 which respectively separate the adjacent induction sources 102. The number of discrete induction sources 102 preferably equals the number of desired puffs to be generated from a cigarette C inserted in the hollow cylindrical cavity defined by cylindrical induction source 100. Each induction source 102 comprises a separate winding of wires 104 forming an excitation coil about the inserted cigarette and connected to an appropriate alternating magnetic field generating circuit. Each induction source 102 further comprises a respective pole piece ring 106 of a material such as ferrite material which collapses the generated magnetic field β inward toward the inserted cigarette.

A thin inner cylindrical wall 120 separates the magnetic field collapsing rings 106 and the adjacent shield rings 114 from the inserted cigarette C. Wall 120 holds the cigarette C and permits air to be ported to the cigarette. Wall 120 can be a suitable material having a low magnetic permeability, and a corresponding high reluctance corresponding to air, such as polyether(ether)ketone or PEEK® polymer commercially available from Imperial Chemical Industries of Great Britain. The cylindrical tube 100, ferrite pole piece rings 106, excitation coils, shield rings 114 and the inserted cigarette C are coaxial.

A single induction source 102 is activated as discussed, causing an alternating current to flow in the excitation coil formed by wound wire 104 and thus generating an alternate magnetic field which is collapsed inward and through wall 120 by the particular pole piece ring 106, and toward a portion of the inserted cigarette C substantially underlying, or encircled by, the first pole piece ring 106. Shield rings 114 located on each side of each excitation coil shield adjacent induction sources 102 from the generated magnetic field, minimize magnetic field lines undesirably impinging on, and thus heating, portions of the cigarette other than the target portion substantially underlying the fired induction source 102, and increase the strength of the magnetic field collapsed onto the underlying cigarette portion. As shown, a gap may be present between wall 120 and the inserted cigarette C to reduce the rigidity of manufacturing tolerances. The magnetic field lines can bridge the gap to inductively heat susceptor material in thermal contact with the tobacco flavor medium. Such a configuration would produce a series of circular burn patterns on the cylindrical cigarette about its longitudinal axis. The firing sequence can be in any desired order, and preferably the induction source corresponding to the distal end of the cigarette relative to the mouth of the smoker, i.e., the outermost induction source relative to the smoker, is fired first. Preferably, the firing does not occur in a linear sequence along the cigarette longitudinal axis. As a result, circumferential rings of the tube of tobacco flavor medium are heated.

Such a cylindrical tube configuration provides a smooth receptacle for repeated insertions of cigarettes. The tube is relatively strong compared to the cigarette and accordingly the induction heating sources should not be damaged upon insertion, adjustment and removal of the cigarettes. Also, a barrier is formed by the tube 120 to prevent potentially component damaging vapors and off-odors from escaping to the other components and air passageways of the electrical smoking article.

Figure 6:
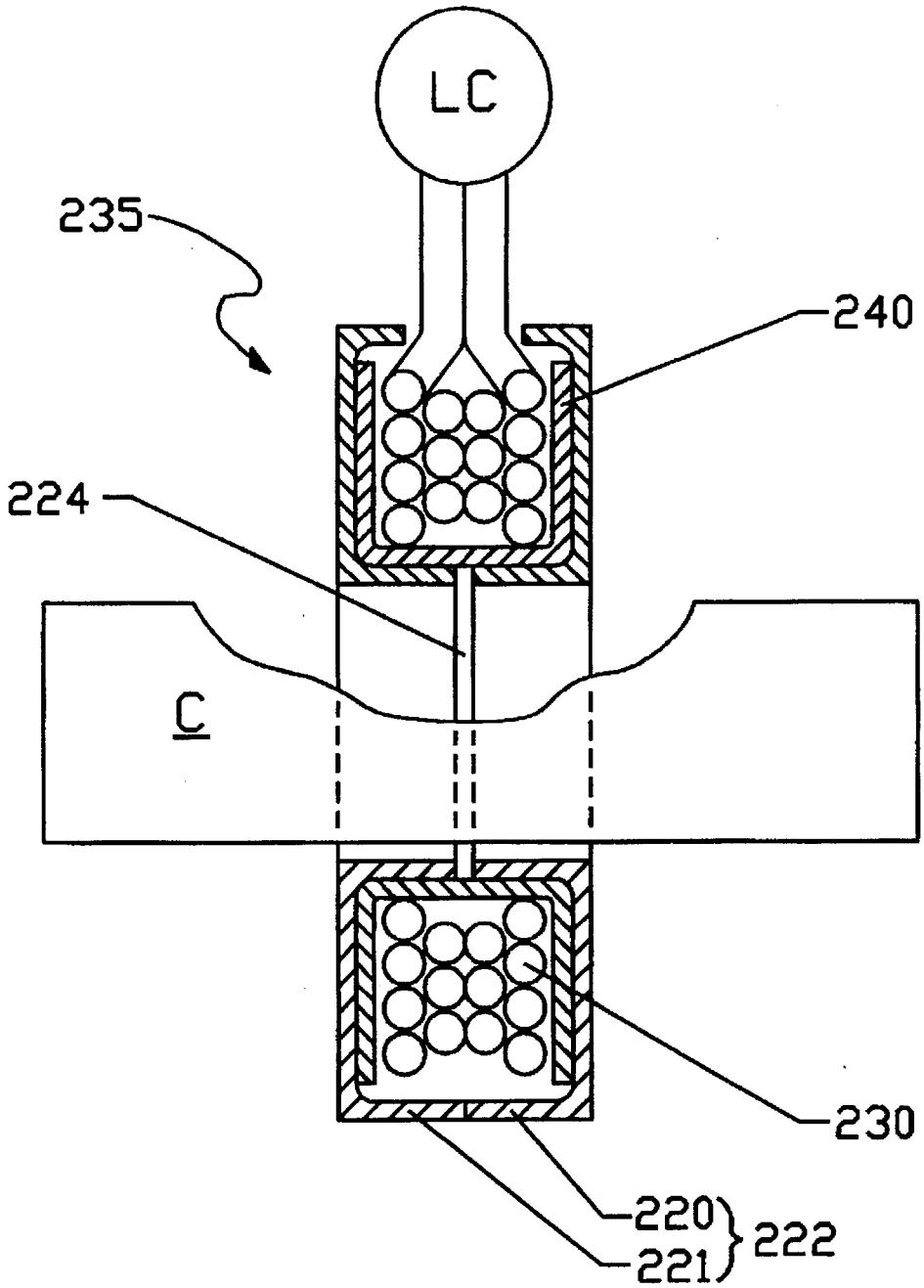
FIG. 6 is an exposed side view of a single generally circular induction heating source with a square cross section.
Figure 7:
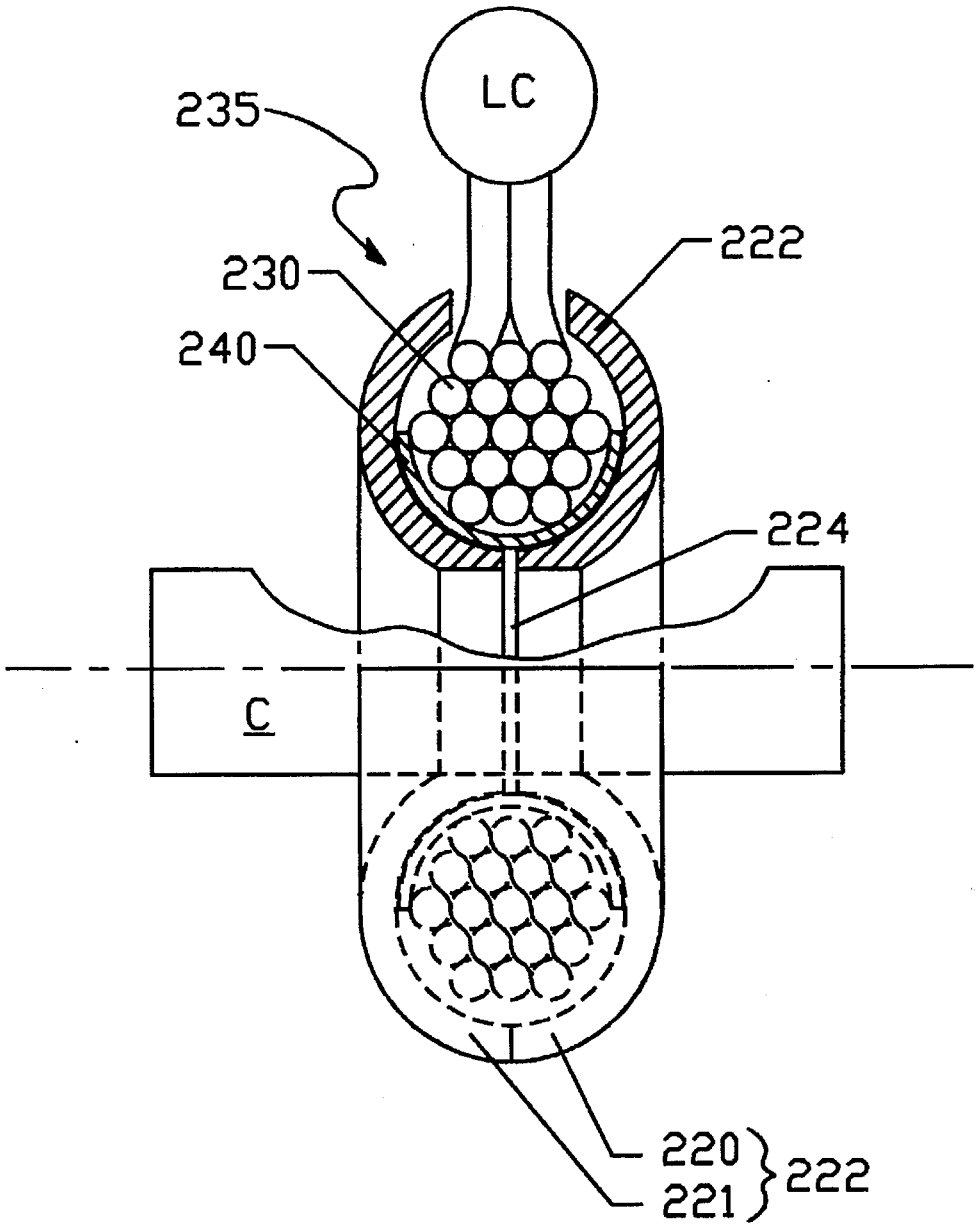
FIG. 7 is an exposed side view of a single generally circular induction heating source with a circular cross section.

Another preferred embodiment is shown in FIGS. 6–7. The induction source 235 comprises a circular, donut-shaped outer shell ring 222 having a hollow central region. The cylindrical cigarette C is inserted through this hollow central region. The ring 222 comprises the two half shells 220 and 221 which are joined and completely closed except for a ring-shaped, annular gap 224 through the inner circumference of the ring. Outer shell ring 222 is preferably comprised of a ferrite material to collapse the magnetic field at the gap 224. Outer shell ring 222 encircles a wire wound to form an excitation coil 230 concentric with outer shell 222 and the inserted cigarette. The excitation coil 230 is connected to an appropriate circuit to generate an alternating magnetic field. A spacer layer 240, which can be semi-circular as shown, is located between the wound excitation coil 230 and the outer shell 222 at gap 224. Spacer 240 serves to facilitate fabrication and to position the excitation coil relative to gap 224 to ensure consistent magnetic gap dimensions; ensure consistent field strength around the annular gap by maintaining rotation orientation; and protect the excitation coil. Spacer 240 is preferably a material having a low magnetic permeability such as polyether(ether)ketone or PEEK® polymer commercially available from Imperial Chemical Industries of Great Britain.

Such a structure results in the entire magnetic path being comprised of the outer shell ring 222 and the gap 224. When the relative permeability of the ferrite is high, the magnetic field strength is strictly a function of the gap characteristics and the excitation current. This embodiment relies on the relatively weak fringing field line emanating from the gap 224 toward the cigarette as opposed to the relatively strong magnetic field established in the gap.

The inner annular gap 224 is preferably equidistant through shell ring 222, i.e., the opposing inner faces of shell ring 222 which define gap 224 are parallel. If the faces are tapered toward the shell outer circumference, i.e., the gap spacing decreases toward the object to be heated, then the relative amount of field fringing increases. However, the magnitude of the fringing field remains approximately the same because the tapering reduces the effective area of the gap, which increases the magnetic path reluctance, which is turn decreases the β-field strength.

The interior cross section of ring 222 defined by half shells 220 and 221 is squared in FIG. 6 and circular in FIG. 7. A circular cross section is preferred to shorten the magnetic path, thus resulting in lower reluctance and higher permeability. A square cross section is preferred for manufacturing.

Each described induction source can comprise an excitation coil comprising single or multiple wires. The wire or wires are wound in a single or multiple turns. The number of amps of current per turn required to generate a magnetic field sufficient to heat the tobacco flavor medium via a susceptor is dependent on the application specific amount of energy delivered to the susceptor target, the maximum desired temperature, the desired rate of temperature rise, coil geometry, and the selected susceptor material(s).

For example, when the excitation coil is activated, an alternating magnetic field is generated and collapses at the gap 224. Computer modeling indicates that the field strength is concentrated across gap 224 and that fringe field effects of this concentration interact with the inserted cigarette C. For successive firings, the ring-shaped induction source 235 and the inserted cigarette C are translated relative to one another to position successive portions of the cigarette in registry with the field concentrates gap 224. Preferably, induction source 235 is translated axially along the relatively stationary cigarette by appropriate mechanical or electromechanical positioning mechanisms. As a result, circumferential rings of the tube of tobacco flavor medium are heated.

In the foregoing examples shown in FIGS. 1–7, a cylindrical cigarette is employed. A preferred cigarette construction is disclosed in related patent application Ser. No. 08/118,665. The cigarette has a diameter of, e.g., approximately 7.8 mm. Since the induction sources do not need to contact the cigarette to transfer energy thereto, the outer curvature of the cigarette does not need to closely approximate the inner circumference of the induction sources 102, 235, thereby allowing for less stringent manufacturing tolerances for the inductive sources and the cigarette C and significantly reducing collision damage to the cigarette C and/or the heater during insertion, adjustment or removal of the cigarette C. Of course, a snug retainment of the cigarette C is desired and can be maintained by close tolerance or a suitable retention mechanism (not shown).

The aerosol generating tobacco flavor medium can take many forms such as filled cylindrical cigarettes, hollow cylindrical cigarettes, or continuous webs as discussed in greater detail below. Regardless of the format employed, the tobacco flavor medium should generate flavors and aerosols subjectively equivalent to a desired puff of a more conventional cigarette with each draw-activated firing of the particular induction source. For example, a hollow cylindrical cigarette should replicate the 7–8 puffs, e.g., 8 puffs, of a conventional cigarette. The energy required to heat a 10.5 $mm^3$ zone of mat of tobacco flavor medium having a density of 0.50 $g/cm^3$ to a required temperature of 600° C. in 0.5 seconds is approximately 1.58 Joules. Of course, the heat capacity and density of the inductively heated susceptor must be taken into account. Preferably, in a layered susceptor/mat arrangement, the susceptor area corresponds to the mat area or is as large as practical with respect thereto since the efficiency of the heat transfer from the susceptor surface to the ultimate target of tobacco flavor medium surface increases as the surface area of the interface between the two surfaces increases.

The cigarette C described in the above patent application Ser. No. 08/118,665 is a hollow cylinder comprised of a tobacco flavor medium, or material including tobacco flavor medium, and a paper overwrap preferably comprising a tobacco-based paper or containing a tobacco flavor coating. As discussed, a susceptor is required since tobacco flavor medium is not capable of being inductively heated. A separate and discrete susceptor element SE can be employed which is a more permanent part of the smoking article, i.e., along with the inductive sources, circuitry, logic, sensors, etc., and which is inductively heated by the induction source(s), to heat the tobacco flavor medium in thermal proximity therewith. In addition or alternatively, susceptor material is a part of the cylindrical cigarette or other format of the tobacco flavor medium. The separate susceptor element can comprise a washer coaxially located around an inserted cylindrical cigarette such that a portion of the washer intersects a radially extending gap of a toroid ring closed except for this gap. The thermal mass of such a discrete susceptor element should not be so high as to function as a heat sink to lower desired rates of temperature rise.

Figure 8:
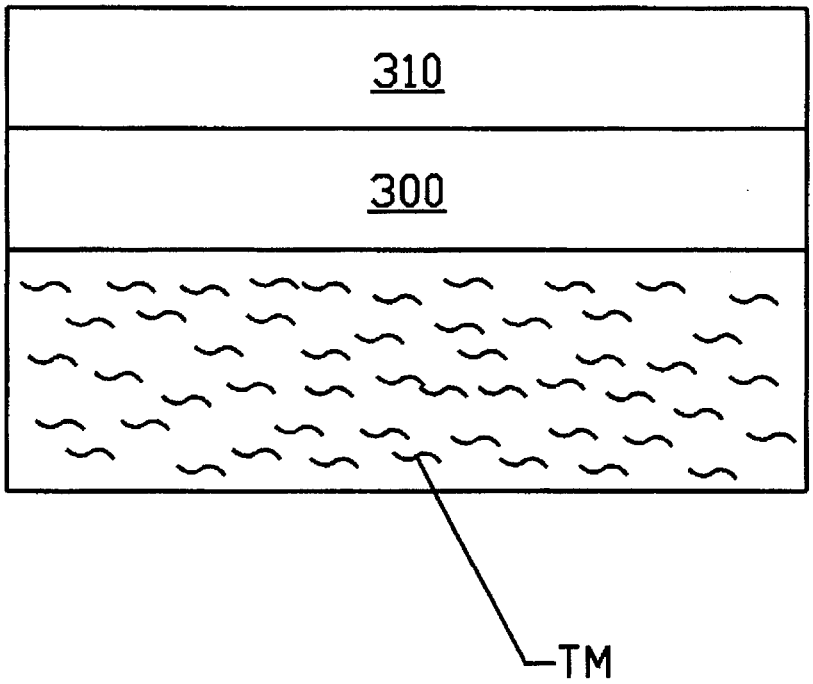
FIG. 8 is an exposed side view of a susceptor and tobacco flavor medium laminate according to the present invention.

Referring to FIG. 8, a cigarette laminate cross-section is shown comprising a cylindrical layer of tobacco flavor material TM, a cylindrical susceptor layer 300 overlying the TM layer, and a paper overwrap 310. The generated magnetic field passes through the paper overwrap 310, which is not heated by eddy currents since paper has a high magnetic permeability, thereby reducing condensation since the paper is not burned through by the magnetic field. The paper overwrap 310 is sized and fabricated so that the paper is not burned through by the heated susceptor. The generated magnetic field induces eddy currents in underlying susceptor layer 300. Susceptor layer 300 is thus heated and predominantly conductively heats the intimately contacting or proximal tobacco material layer TM to evolve desired flavors.

The susceptor material used in the present invention should have a low magnetic reluctance and a correspondingly high relative magnetic permeability to optimize the surface eddy currents generated by an alternating electromagnetic field of a given strength. The susceptor should also have relatively low electrical resistivities to increase Joule heat dissipation. The lower the product of specific heat and density, the greater the heating efficiency. A material with a high relative permeability can be employed to invoke the additional heating mechanism associated with magnetic hysteresis. The susceptor layer 300 should have a thickness which is relatively thin relative to its particularized, excitation frequency-dependent skin depth so that the vast majority of the magnetic field creates heat producing eddy currents in the susceptor. This is especially advantageous when fringing fields from a split gap arrangement are present. As the thickness of the susceptor increases, the magnetic field is unable to penetrate deep enough into the material, necessitating an undesired power increase requirement to heat the increased thermal mass of the susceptor. If the susceptor layer is too thin, e.g., much less than the skin depth, a low conversion of the magnetic field to heat energy via eddy currents occurs. If the susceptor layer is too thick, e.g., greater than three skin depths, a high conversion efficiency results but the susceptor thermal load, i.e., the mass, reduces the rate of thermal rise. Most non-permeable metals reach an optimum magnetic field of, e.g., approximately 550 gauss at about a 2 mil thickness at an excitation frequency of 500 KHz. Preferably, the magnetic field is between approximately 400 and 800 gauss. The minimum theoretical required power is 3.5 watts to reach a desired temperature of 500° C., from room temperature conditions in approximately one second. Possibly suitable susceptor materials may include conductive carbon such as graphite, aluminum, stainless steel, copper, bronze, or any combination thereof with aluminum alone or in combination being preferred. Materials having similar ranges of electrical resistivity and magnetic permeability can be employed alone or in combination. A desired susceptor thickness is between approximately 0.25 and 0.5 mil.

The paper overwrap 310 overlying susceptor 300 has a sufficient thickness and/or gaseous impermeability to retain the vast majority of the generated aerosols interior to the formed cylinder to ensure a maximum aerosol delivery to the smoker and to further reduce escape of aerosols from the cigarette interior which could cause component damaging condensation. The overwrap 310 should have sufficient thickness and/or burn rate characteristics to avoid being burned by the heated susceptor 300. As stated above, no eddy currents are generated in the paper overwrap by the inductive heating source. The order of the layers 300 and 310 could be reversed; however, such an arrangement would necessitate heat being unnecessarily conducted through the paper layer to the tobacco flavor medium, possibly producing vapors. Appropriate adhesives are employed to bond the susceptor layer 300 to the paper overwrap 310 and the tobacco substrate. The susceptor layer 300 and the overwrap 310 can constitute a foil laminate, e.g., an aluminum foil laminate.

Figure 9:
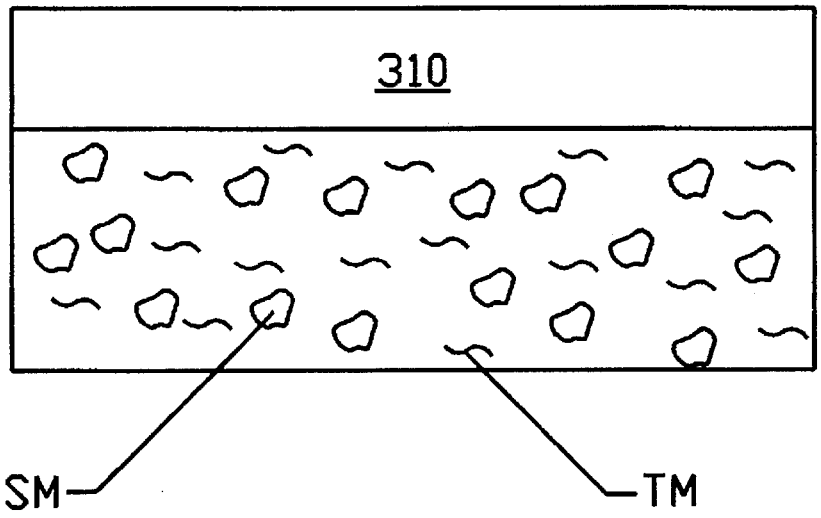
FIG. 9 is an exposed side view of a tobacco flavor medium having a discontinuous susceptor medium therein.

In addition to this susceptor/tobacco flavor medium laminate embodiment, other embodiments of the present invention form a combined layer of tobacco flavor medium and susceptor. These embodiments minimize unintentional heating of adjacent portions of tobacco flavor medium due to conduction from the inductively heated target susceptor, through another portion of the susceptor, and to the adjacent, non-target tobacco flavor medium portion. For example, susceptor materials SM are dispersed in the tobacco flavor medium TM in a sufficient amount to conductively heat the surrounding tobacco flavor medium when excited, as shown in FIG. 9. Susceptor medium SM can be continuous fibers, broken fibers, particles, or any combination thereof. These susceptor particles are not in a conductive relationship with one another to reduce undesired conductive heating of neighboring, non-target susceptors and tobacco flavor medium portions. These susceptor materials can be interposed in patterns to delineate target areas to be inductively heated.

Figure 10A:
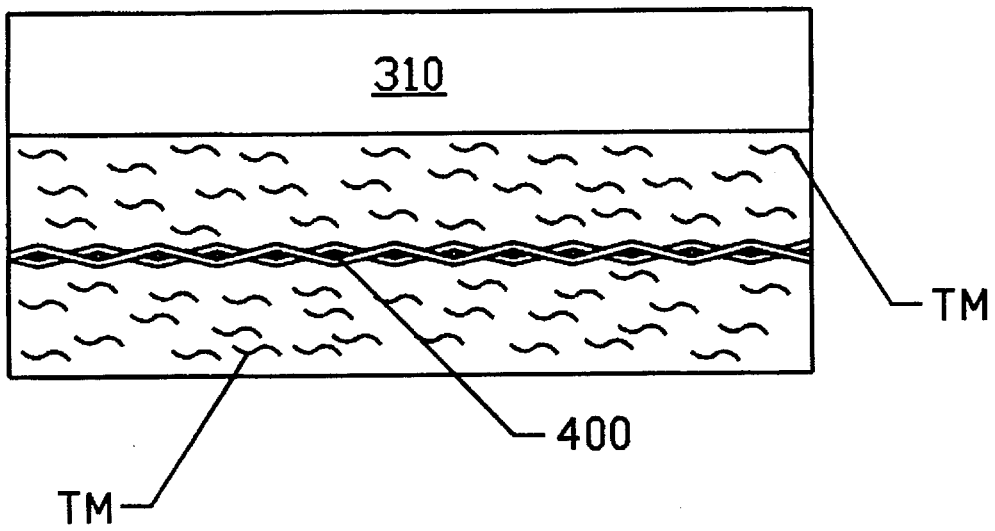
FIG. 10A is an exposed side view of a tobacco flavor medium having a meshed wire susceptor.
Figure 10B:
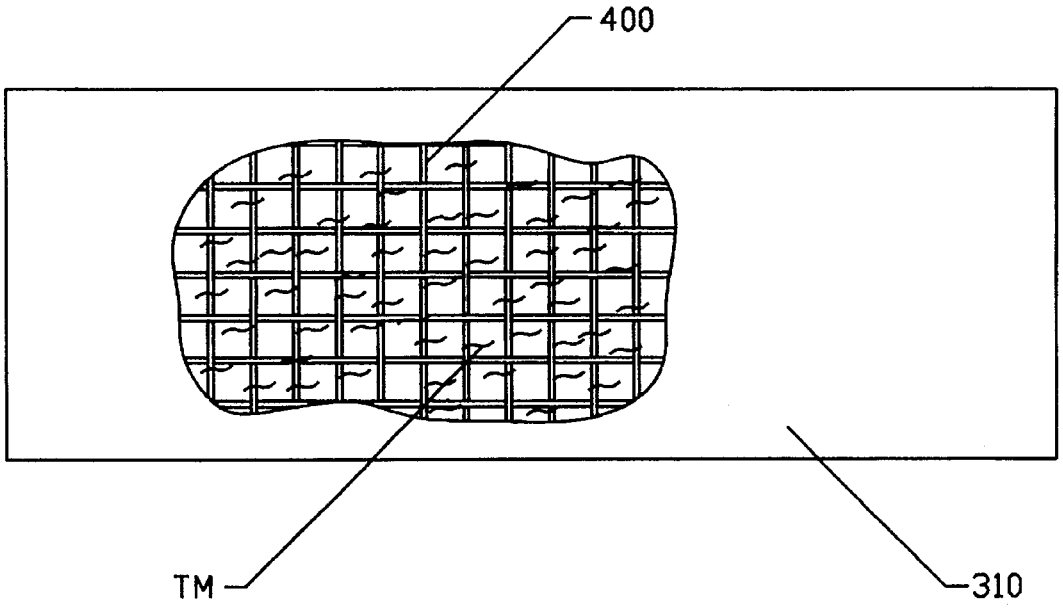
FIG. 10B is an exposed top view of a tobacco flavor medium of FIG. 10A.
Figure 10C:
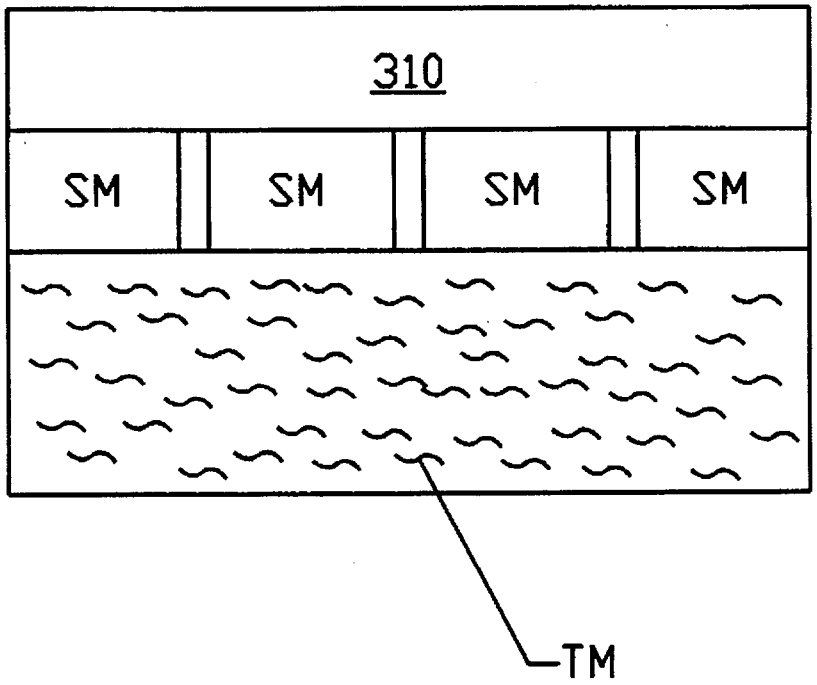
FIG. 10C is an exposed side view of a tobacco flavor medium and discontinuous susceptor laminate.

A particularly preferred embodiment is shown in FIGS. 10A–C. The susceptor comprises an integral layer 400 having various discontinuities 410 therethrough. For example, integral layer 400 can be a screen, mesh or perforated foil of a suitable susceptor material and is intermeshed with, and preferably encapsulated or completely surrounded by, the tobacco flavor medium TM, as shown in FIGS. 10A and 10B. This arrangement increases the effective interface area between the susceptor and tobacco flavor medium since the vast majority of the susceptor area is in thermal contact with the tobacco flavor medium to conduct heat thereto. Heat conduction in the plane of the susceptor 400 is decreased by the discontinuities 410, thereby reducing heating of non-target portions of tobacco flavor medium. The mechanical, and more specifically the tensile, strength of such an embodiment is superior to that employing interposed susceptor particles since an integral frame is provided to support the tobacco flavor medium, especially the relatively fragile heated tobacco flavor medium. This configuration is also more flexible than a susceptor/tobacco flavor medium laminate due to the discontinuities, perforations, or openings. Also, such a configuration has a lower thermal mass than a discrete susceptor layer, lowering energy requirements. In addition, this susceptor geometry results in a faster thermal response for the susceptor, thereby favorably increasing the evolution rate of the aerosol flavor to more quickly heat the tobacco flavor medium. The discontinuities 410 allow the evolved aerosols to flow through the susceptor 400, increasing aerosol mass transfer in the desired flow direction.

Referring to FIG. 10C, an embodiment is shown comprising a laminate of tobacco flavor medium TM, a layer of susceptor material SM, and a paper overwrap 310. The embodiment is similar to the embodiment of FIG. 8 except that the layer of susceptor material SM comprises discrete portions of susceptor material separated by gaps. Thus gaps are relatively uniform as shown or can be tapered either toward paper overwrap 310 or the layer of tobacco flavor medium TM.

The discrete susceptor layer 300 described above can also have discontinuities and can take the form of a screen, mesh or perforated foil. For example, a paper foil laminate can be employed wherein strips of foil are provided. If an impermeable susceptor layer is employed, a vapor barrier is typically produced between the susceptor layer and the tobacco flavor medium TM. This vapor barrier reduces the heat transfer from the susceptor layer to the tobacco flavor medium. The presence of discontinuities permits the constituents which comprise the vapor barrier to pass through the susceptor.

This discontinuous susceptor can be employed to heat tobacco flavor medium in any desired geometrical shape for smoking. For example, the tobacco flavor medium can be in the form of a filled or hollow cylinder, as described in Ser. No. 118,665 or a web such as that discussed in Ser. No. 08/105,346.

As discussed above, to heat respective regions of the tobacco flavor medium to generate respective puffs, either the induction source is indexed relative to the tobacco flavor medium, or visa versa, or both are moved relative to each other. Preferred embodiments wherein the tobacco flavor medium is indexed relative to a stationary induction heating source are found in commonly assigned patent application Ser. No. 08/105,346.

Ser. No. 08/105,346 discloses a system for registering a web of tobacco flavor medium in thermal proximity with an electrical resistance heat source. A portion of the web is supported in thermal proximity to the heat source, heated to generate a tobacco flavor substance, and then advanced past this registry point. If a supply of web is provided, this advancement results in a subsequent web portion being registered with the electrical heating source.

Figure 11:
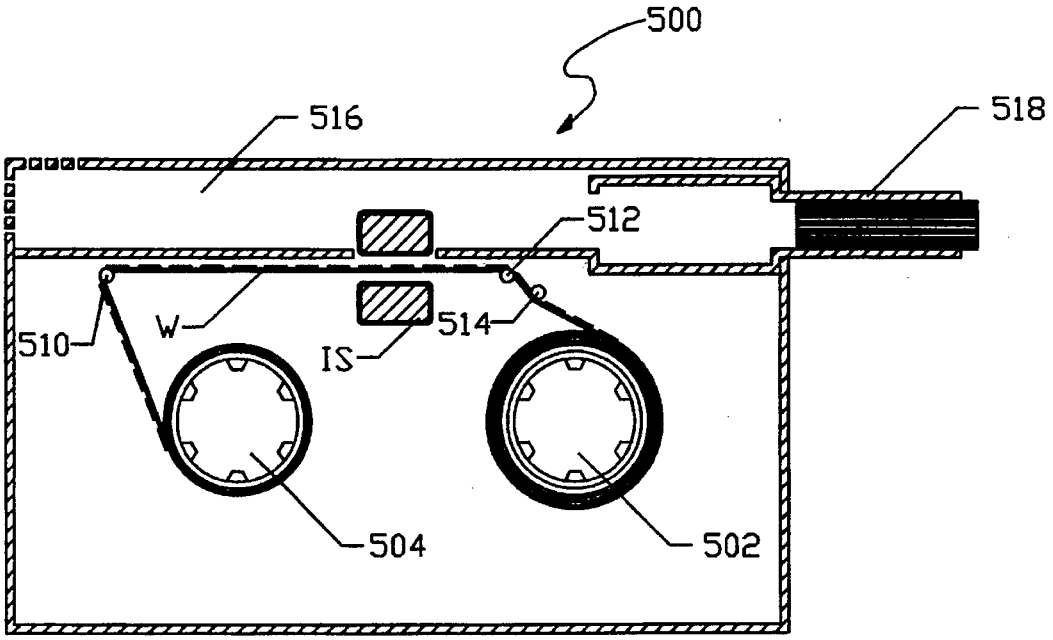
FIG. 11 is a schematic of a smoking article employing a web bearing tobacco flavor medium and an induction heating source according to the present invention.
Figure 13:
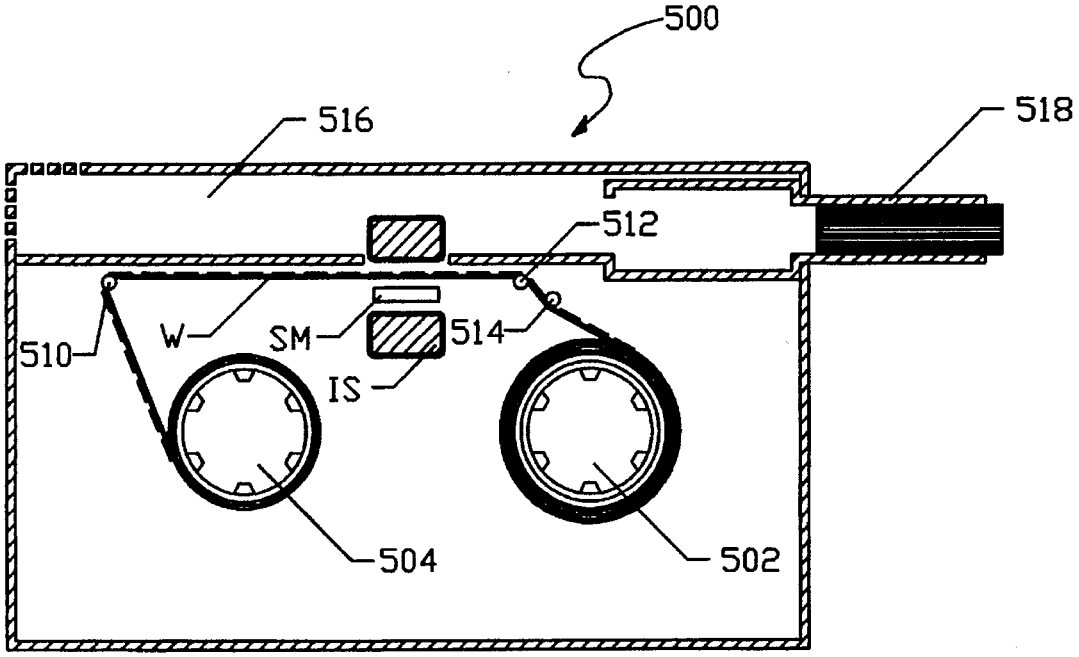
FIG. 13 is a schematic of a smoking article employing a web bearing flavor medium, an induction heating source and a relatively permanent susceptor according to the present invention.

As shown generally in FIGS. 11 and 13, a smoking article 500 has a powered capstan 502 driven by appropriate motor and gearing and an unpowered capstan 504. A supply of a web W of tobacco flavor medium is spun on a spool mounted on unpowered capstan 504 and is guided from the supply spool over an idle guide roller 510, into registry with an induction heating source generally designated as IS, over idle guide rollers 512 and 514, to a take-up spool mounted on and driven by powered capstan 502. The registered web, described in greater detail below, is heated by susceptor(s) inductively heated by source IS to generate an aerosol in chamber 516 which is drawn by the smoker via mouthpiece 518.

The induction heating source IS can be any induction heating source according to the present invention. More specifically, the C-shaped or E-shaped induction heating source 10 of FIGS. 1 and 2 or the induction heating source of FIGS. 6 and 7 having a split ring 222 are employed. In FIGS. 11 and 13, the preferred C-shape of FIG. 2 is shown. Any other suitable geometry capable of producing an alternating β field of sufficient strength can be employed.

Figure 12A:
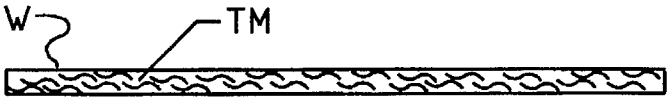
FIG. 12A is an exposed side view of a web comprising tobacco flavor medium and, if desired, susceptor material.
Figure 12B:
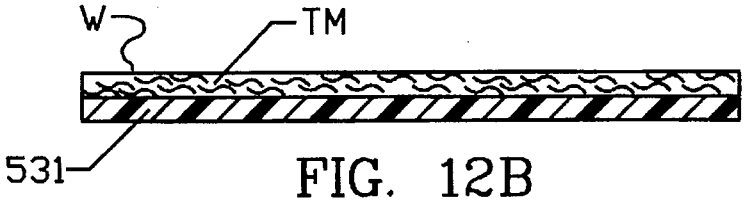
FIG. 12B is an exposed side view of a web according to FIG. 12A further comprising a supporting, and optionally a susceptor, substrate.

The web W comprises or bears tobacco flavor medium. The web can have the general configuration described above in reference to FIGS. 8–10C. More specific embodiments will now be discussed with reference to FIGS. 12A–12G. The web W may be made of the tobacco flavor medium TM itself, formed into an elongated sheet form by methods that are well known in, e.g., the manufacture of reconstituted tobacco products, as shown is FIG. 12A. The tobacco flavor medium is mixed with susceptor material SM as discussed above in reference to FIG. 8 if the web is used in the embodiment of FIG. 11, and, if desired, with the embodiment of FIG. 13 employing a separate susceptor element. Such an alternative may be sufficient in some applications, depending on the smoking article, and the amount of friction and tension expected from web advancement. If the configuration is such that an unsupported web may break, especially after heating when the web is weakened, then an alternative like that shown in FIG. 12B may be used. As shown in FIG. 12B, web W is a laminate of tobacco flavor medium TM and a support layer 531. Support layer 531 may be a woven or non-woven carbon fiber mat, for which suitable carbon fibers might be one-inch-long chopped carbon fibers available from Akzo Fortafil, Inc., of Rockwood, Tenn., a subsidiary of Akzo America, Inc., of Chicago, Ill., as FORTAFIL®3C. Layer 531 may also be any other suitable material e.g., suitably treated paper that adds strength to layer TM and can withstand the temperatures to which layer TM will be heated without generating subjective off tastes. Support layer 531 can function as a susceptor as described above in reference to FIG. 9 if the proper material is selected. If so, tobacco flavor medium layer TM can be provided with susceptor material SM or not, depending on whether the eddy currents generated in the susceptor support layer 531 are sufficient to adequately heat layer TM.

Figure 12C:
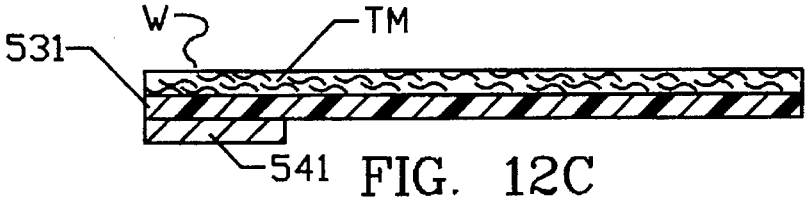
FIG. 12C is an exposed side view of a web according to FIG. 12B further comprising a support strip.
Figure 12D:
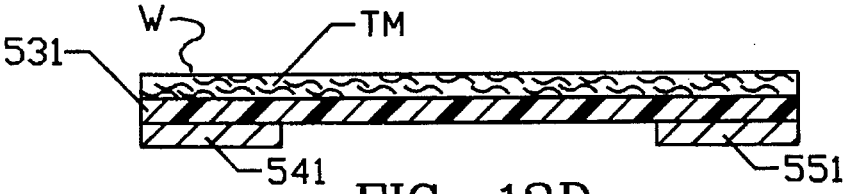
FIG. 12D is an exposed side view of a web according to FIG. 12C further comprising an additional support strip.

It may be found that additional support is needed beyond that provided by support layer 531. As shown in FIG. 12C, web W further includes reinforcing strip 541. Strip 541 may be paper, metallic foil, or a foil/paper laminate. As seen in FIG. 12D, further support can be provided by a second reinforcing strip 551 similar to strip 541.

Figure 12E:
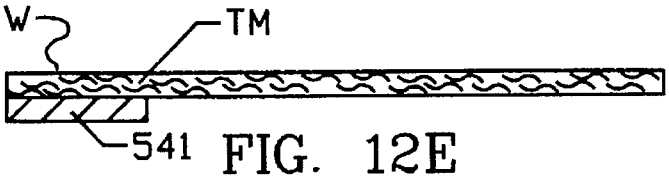
FIG. 12E is an exposed side view of a web according to FIG. 12A further comprising a support strip.
Figure 12F:
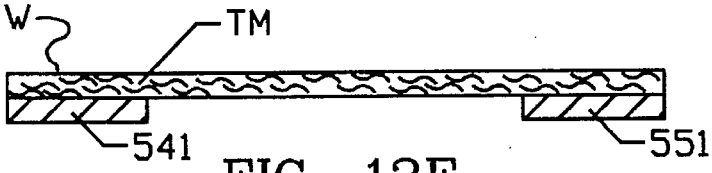
FIG. 12F is an exposed side view of a web according to FIG. 12E further comprising an additional support strip.

In another alternative embodiment, it may be found that strip 541, or the combination of strips 541, 551 is sufficient to support continuous tobacco flavor medium strip and two such alternate embodiments are shown in FIGS. 12E and 12F.

Figure 12G:
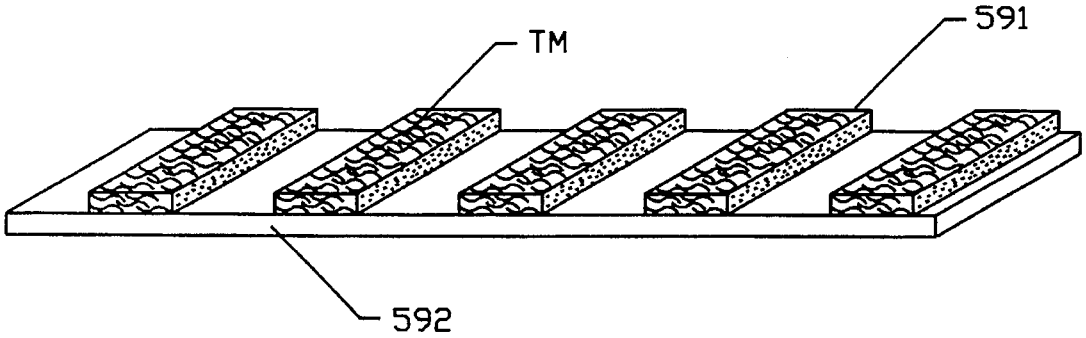
FIG. 12G is a perspective of a web comprising discrete portions of a tobacco flavor medium and, if desired, susceptor material.

Another embodiment of a flavor web according to this invention is shown in FIG. 12G. In this embodiment, individual portions 591 of tobacco flavor medium TM are deposited on a carrier web 592. Any of the alternative structures shown in FIGS. 12B–12F can be used in this embodiment. This embodiment requires greater accuracy in web transport than the first embodiment, so that portions 591 are in inductive registry with the alternating magnetic field. However, depending on the relative heat conductivities of the various web materials, both embodiments must be advanced approximately the same distance between puffs, as discussed above, to prevent reheating of tobacco flavor medium to avoid generation of off-tastes.

An alternative embodiment is shown in FIG. 13 wherein induction heating source IS inductively heats one or two susceptor elements of susceptor material SM located near, or contacting the web W travel, between the supply and take-up reels 502 and 504. The discrete element of any suitable susceptor material SM heats the web W which is in intimate thermal contact therewith. In the configuration shown, the susceptor roller(s) 515 is in the chamber 516 and is fixed relative to the web. Roller 515 can rotate to advance the web and can also translate slightly with the web to reduce tension on the web. Web W can be any of the previously discussed embodiments of FIGS. 12A–12G and can contain additional susceptor material as described if necessary to adequately heat the tobacco flavor medium.

A preferred embodiment for providing a susceptor to inductively heat the tobacco flavor medium is now discussed. This embodiment is applicable to tobacco flavor medium in the form of a cylindrical shape, a web, or any other suitable geometric shape to be smoked.

A susceptor material is employed having a high magnetic permeability and a low specific electrical resistivity such as any mentioned material which is capable of heating a tobacco substrate to temperatures necessary to produce aerosol delivery within a smoking device when exposed to an alternative magnetic field. For example aluminum or silver ink are employed. The susceptor is formed by mixing a food grade binder, e.g., a hydrocolloid such as pectin or Konjac, along with other minor components and a susceptor filler. The resulting ink is then applied in the desired geometry via a conventional method of application to the desired tobacco flavor medium and/or paper substrate. This ink can be used to fabricate susceptors of two general types. In the first case, the ink is cured by drying at low temperatures, e.g., about room temperature. This results in a susceptor element which consists of conductive/resistive (permeable) filler particles within the binder matrix. The time and temperature of curing determines the volumetric ratio of filler to binder and thus influences the measured reluctance of the element in accordance with percolation phenomena. This type of susceptor can be deposited and cured on substrates which cannot tolerate exposure to high temperatures, e.g., cellulose materials such as tobacco or paper. In the second case, the ink can be deposited on a high temperature substrate such as alumina and elevated to temperatures high enough and times long enough to oxidize the binder leaving a "film" composed of the susceptor material. The final magnetic reluctance will depend on the original loading of the filler in the ink, the filler material, the intimacy of the diffusion or flow of the filler material into the substrate surface, and the time temperature history of the deposited film. These parameters impact the final particle morphology which influences the resistance, apparent resistivity, of the element.

The produced ink is applied to the paper and/or the tobacco flavor medium via screen printing, gravure printing, ink jet application, vapor disposition, vacuum disposition, plasma spraying, etc.

The susceptor ink is thus printed or otherwise deposited in paper and/or tobacco flavor medium. Preferably, the susceptor is in contact with the tobacco flavor medium. If printed on paper, the susceptor is preferably in the side of the paper facing the tobacco flavor medium. The paper should be thick enough and/or have appropriate burn rate characteristics to minimize burning as the susceptor ink is heated. A paper overwrap as discussed above can be employed.

This embodiment offers several advantages. Various conventional food grade binders are used which are compatible with tobacco material. The curing of the ink is at room temperature, thereby simplifying the process and avoiding undesired thermal post treatment of susceptors applied to the tobacco flavor medium which could alter the concentrations of volatile flavor components. The curing can be accelerated by slightly elevating the curing temperature. The resulting susceptor patterns are flexible, permitting use with tobacco flavor medium substrates which are later rolled, bent or otherwise fabricated to achieve a specific geometry.

The printed susceptor has a low mass, thus decreasing the amount of energy stored in the susceptor mass and resulting in greater heater transfer efficiency to the substrates. The susceptor ink can be applied using conventional printing technology such as the discussed screen or gravure printing. The printing and the rheological characteristics of the ink result in an integration of the heater film into the tobacco flavor medium substrate. This integration results in an intimate contact between the susceptor materials and the substrate, resulting in good thermal transfer via conduction. Also, such an integrated, printed susceptor is less likely to delaminate.

The amount of heat transferred depends on the type of susceptor material selected, the relative ratio of susceptor material to the ink, and the particular geometric pattern of ink employed. This pattern should be located on the tobacco flavor medium filler and paper such that the applied susceptor material is inductively registered with the generated magnetic field upon insertion and activation.

The susceptor ink can be applied as a uniform coating or layer as discussed in the above embodiments. Alternatively, a pattern can be printed for discrete regions, each region integrated and in intimate contact with a corresponding region of tobacco flavor medium sized to generate a puff. The printed susceptor regions are separated to avoid undesired induction heating of adjacent susceptor regions, e.g., the susceptor regions are spaced apart on a tobacco flavor medium substrate.

Regardless of the susceptor tobacco flavor medium configuration employed, the susceptor is in thermal contact with the tobacco flavor medium, i.e., these elements are located such that the inductively heated susceptor transfers a sufficient amount of heat to the tobacco flavor medium to evolve aerosols.

Figure 14:
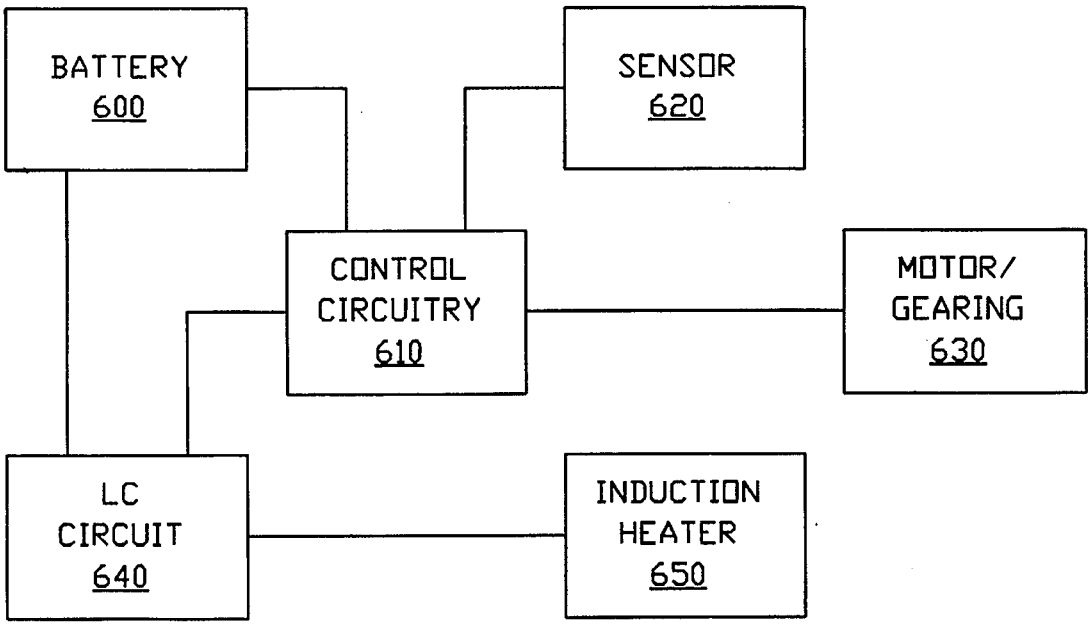
FIG. 14 is a block diagram of a smoking article employing the present invention.

A simplified schematic is shown in FIG. 14 of an electrical smoking article employing an induction heater according to the present invention. The represented power source, e.g., a battery, 600, control circuitry 610, sensor 620 and optional motor/gearing 630 are described in greater detail in the noted related applications incorporated by reference herein. Sensor 620 generates a signal in response to the smoker drawing on the particular electrical article. The "draw" signal is fed to control circuitry 611 which sends a "fire" or discharge signal to the LC circuit 640. LC circuit 640 is powered by battery 600. The LC circuit 640 sends an alternating current to the single induction heater 650, or one or more of the plurality of heaters to generate the alternating magnetic field to heat the susceptor. Motor/gearing 630 is powered by battery 600 and activated by control circuitry 610 as described in Ser. No. 08/105,346 to register the induction heater or fixed susceptor with the moving web. Alternatively, motor/gearing 630 is used to move the cigarette and induction heater relative to one another as described.

Any appropriate circuit for generating an alternating current for the excitation coils to convert into an alternating magnetic field can be employed.

Figure 15:
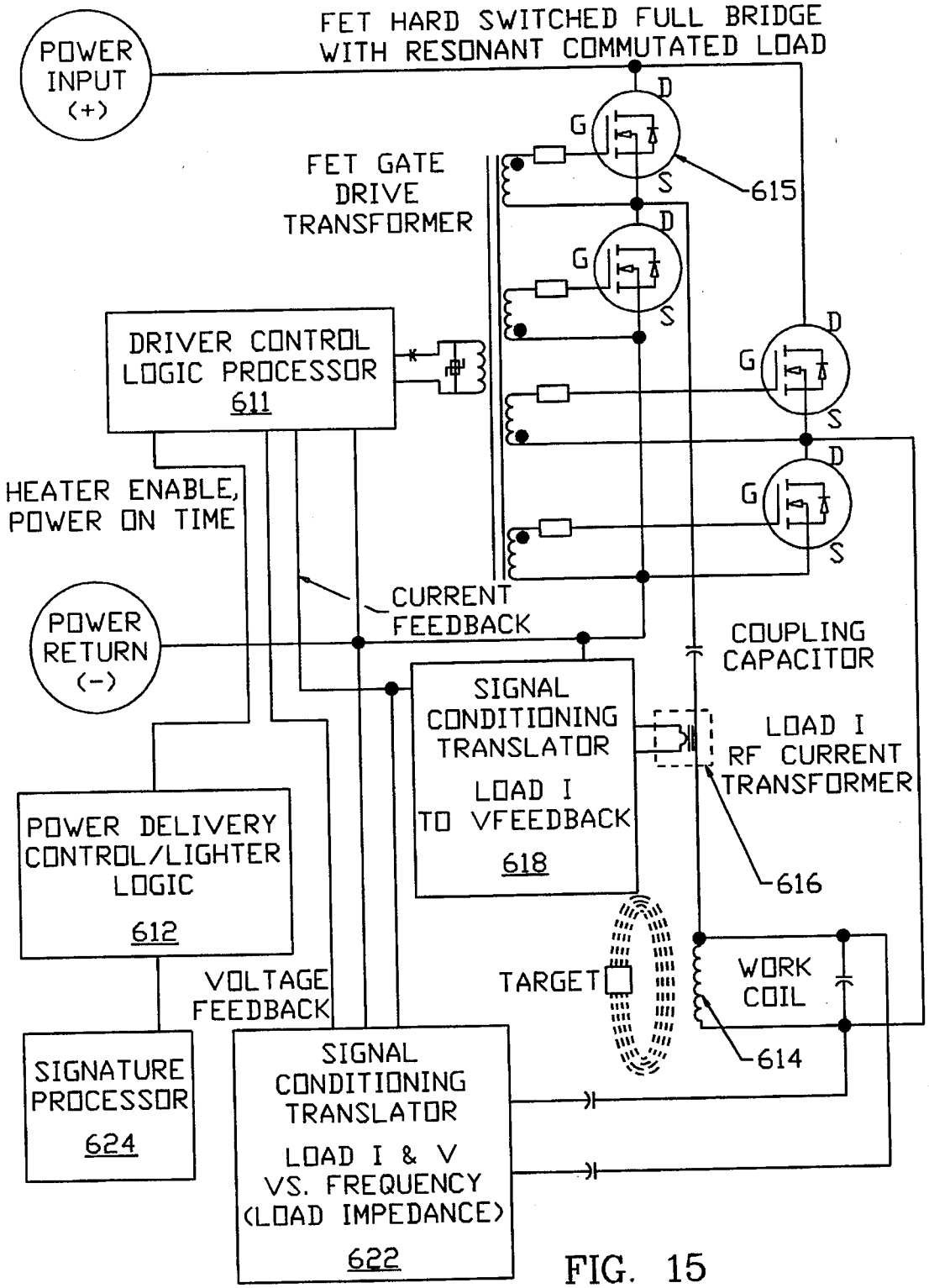
FIG. 15 is a schematic of a circuit of the present invention.

An exemplary control circuit shown in FIG. 15 consists of a control circuitry 611 such as PWM (pulse width modulated) control logic integrated circuit driver chip, which drives FET (Field Effect Transistor) driver transformers 615.

The FET's 615, four as shown, are connected in a full bridge configuration. This preferential circuit topology is used to maximize the power transfer to the work excitation coil 614 while minimizing source impedance and reducing switching losses. The input supply voltage, depending on circuit application, would range between 3 and 24 VDC. The power delivery from power supply 600 (shown in FIG. 14) to the work coil 614 is dynamically (realtime) monitored by the use of a current transformer 616. The scaled current from the current transformer 616 is routed into a first signal conditioning network 618 and converted into a voltage to provide an error signal to the PWM controller 611. The voltage scaled signal also feeds a second separate signal conditioning network 622 which provides a varying DC signal related to the reflected impedance of the susceptor within a cigarette, and the susceptor's particular physical properties such as resistance, magnetic permeability, geometry, etc. This signal is routed into a circuit subsystem labelled signature processor 624. The cigarette susceptor's impedance is monitored upon cigarette insertion into the lighter subsystem, by the application of less than 5% of the nominal applied power for short "burst" of a magnetic field having less strength than the magnetic field generated to heat the susceptor, i.e., the initial field is incapable of heating the susceptor. The cigarette susceptor reflects impedances into the work coil 614 dependent on the applied frequencies. The signature processor 624 compares the reflected load impedance with stored values in a ROM table at several arbitrary frequencies. The accuracy of discrimination of the cigarette susceptor, and detection of off-specification cigarettes or foreign objects is based on the number of test frequencies used and the tolerance window allowed for each test response. The signature processor 624 provides a "GO/NO-GO" permissive signal to a power delivery control and logic subsystem 612 of the lighter, which then controls the synchronization and on-time operation of the PWM control logic driver chip 611. The signature processor 624 also detects unexpected energy delivery to the susceptor due to a significant shift in detected susceptor's physical properties and interrupts operation of the lighter by turning off the PWM controller chip 611 via subsystem 612.

Many substitutions, modifications and improvements may be apparent to the skilled artisan without departing from the spirit and scope of the present invention as described and defined in the specification and following claims.

We claim:

1. A heating system for an electrical smoking article for smoking tobacco flavor medium comprising:

a generator for producing an alternating magnetic field, a susceptor material which is inductively heatable by the alternating magnetic field and positioned relative to the generator so as to be heatable by the alternating magnetic field, and a tobacco flavor medium in thermal proximity to the susceptor material.

2. The heating system according to claim 1, wherein said generator comprises:

a ferrite structure; and an excitation coil wrapped around said ferrite structure.

3. The heating system according to claim 2, wherein the ferrite structure comprises an E-shaped structure having two end legs and a middle leg extending in the same direction from a common section, wherein said excitation coil is spiraled around the middle leg.

4. The heating system according to claim 2, wherein the ferrite structure comprises a C-shaped structure having two end legs extending in the same direction from a common section, wherein said coil is spiraled around the common section.

5. The heating system according to claim 2, wherein said ferrite structure comprises a ring defining a hollow annular interior and said excitation coil is wound through the annular interior, said ring encircling the tobacco flavor medium.

6. The heating system according to claim 5, further comprising a magnetically permeable spacer located in the hollow interior between said excitation coil and said ring.

7. The heating system according to claim 1, wherein said susceptor element is aluminum, conductive carbon, graphite, stainless steel, copper, bronze or a combination thereof.

8. A heating system for an electrical smoking article for smoking a tobacco flavor medium in thermal proximity to a susceptor material, the heating system further comprising:

a controller which activates said induction source.

9. The heating system according to claim 8, wherein said controller comprises means for activating said induction source at a desired time and for deactivating said induction source after a predetermined period.

10. The heating system according to claim 8, wherein said controller is responsive to a draw upon the smoking article.

11. The heating system according to claim 8, further comprising a means for determining whether an appropriate susceptor material is present, said determining means activating said controller only if an appropriate susceptor material is present.

12. The heating system according to claim 8, wherein said controller applies an initial alternating magnetic field to an intended location of the susceptor material, the initial magnetic field being incapable of inductively heating the susceptor material, and said controller determines whether to apply the alternating magnetic field based upon a reflection of the initial magnetic field indicating presence of a desired susceptor material.

13. The heating system according to claim 8, wherein said controller is connected to a detector for measuring a physical property and deactivates said induction source in response to a shift in a detected characteristic of the susceptor material.

14. The heating system according to claim 8, wherein the tobacco flavor medium comprises a web having tobacco flavor medium therealong; and the system further comprises means for supporting a section of said web in thermal proximity to the susceptor material within the alternating magnetic field of the induction source; and means for advancing said web to present a successive section having said tobacco medium in thermal proximity to the susceptor material therealong within the alternating magnetic field of the induction source.

15. The heating system according to claim 1, further comprising a hollow region for allowing a draw by a smoker, and means for activating the generation of an alternating magnetic field by said induction heater in response to a draw by a smoker.

16. A heating system as claimed in claim 15, wherein the hollow region is a mouthpiece or an opening for the insertion of a cigarette.

17. The heating system according to claim 1, wherein the tobacco flavor medium comprises a web having tobacco flavor medium therealong; and wherein the heating system further comprises means for supporting a section of said web in thermal proximity to the susceptor material within the alternating magnetic field of the induction source and means for advancing said web to present a successive section having said tobacco medium in thermal proximity to the susceptor material therealong within the alternating magnetic field of the induction source.

18. A heating system for an electrical smoking article for smoking a tobacco flavor medium in thermal proximity to a susceptor material heated inductively by an alternating magnetic field, the heater comprising:

a ferrite ring structure capable of and adapted for encircling the tobacco flavor medium and susceptor;

an excitation coil wrapped around said ferrite structure and wound through the annular interior; and a ring gap defined through an inner circumferential wall of said ferrite ring structure, whereby the alternating magnetic field collapses at the defined gap.

19. A heating system for an electrical smoking article for smoking a tobacco flavor medium in thermal proximity to a susceptor material, the heating system comprising:

a plurality of generators for producing an alternating magnetic field, susceptor material which is capable of being heated by said alternating magnetic field and positioned relative to the generators so as to be heatable by the alternating magnetic field, and a tobacco flavor medium, wherein said susceptor material is located in thermal proximity to the tobacco flavor medium, and wherein said plurality of generators are positioned to heat separate portions of the tobacco flavor medium via the susceptor material.

20. The heating system according to claim 19, wherein the tobacco flavor medium is cylindrical and said plurality of generators are arranged circumferentially around the cylindrical tobacco flavor medium.

21. The heating system according to claim 19, wherein each of said generators comprise:

a ferrite structure; and an excitation coil wrapped around said ferrite structure.

22. The heating system according to claim 21, wherein the ferrite structure comprises an E-shaped structure having two end legs and a middle leg extending in the same direction from a common section, wherein said excitation coil is spiraled around the middle leg.

23. The heating system according to claim 21, wherein the ferrite structure comprises a C-shaped structure having two end legs extending in the same direction from a common section, wherein said coil is spiraled around the common section.

24. The heating system according to claim 21, wherein said ferrite structure comprises a ring defining a hollow annular interior and said excitation coil is wound through the annular interior, said ring encircling the tobacco flavor medium.

25. The heating system according to claim 24, further comprising a magnetically permeable spacer located in the hollow interior between said excitation coil and said ring.

26. The heating system according to claim 19, wherein said susceptor material is aluminum, conductive carbon, graphite, stainless steel, copper, bronze or a combination thereof.

27. The heater according to claim 21, wherein said susceptor element is aluminum, conductive carbon, graphite, stainless steel, copper, bronze or a combination thereof.

28. The heating system according to claim 19, further comprising a hollow region for allowing a draw by a smoker, and means for activating the generation of an alternating magnetic field by one of said plurality of induction heaters in response to a draw by the smoker.

29. A heating system as claimed in claim 28, wherein the hollow region is a mouthpiece or an opening for the insertion of a cigarette.

30. The heating system according to claim 19, wherein the tobacco flavor medium comprises a web having tobacco flavor medium therealong; and wherein the heating system further comprises means for supporting a section of said web in thermal proximity to the susceptor material within the alternating magnetic field of the induction source and means for advancing said web to present a successive section having said tobacco medium in thermal proximity to the susceptor material therealong within the alternating magnetic field of the induction source.

31. A heating system for an electrical smoking article for smoking a cylindrical tobacco flavor medium in thermal proximity to a susceptor material, the heating system comprising:

a plurality of generators for producing an alternating magnetic field;

a susceptor material which is capable of being heated by said alternating magnetic field and positioned relative to the generators so as to be heatable by the alternating magnetic field; and a cylindrical tobacco flavor medium, wherein said susceptor material is located in thermal proximity to the cylindrical tobacco flavor medium, and wherein said plurality of generators are positioned to heat separate portions of the tobacco flavor medium via the susceptor material and are arranged circumferentially around the cylindrical tobacco flavor medium in the same plane.

32. A heating system for an electrical smoking article for smoking a cylindrical cigarette tobacco flavor medium in thermal proximity to a susceptor material, the heating system comprising:

a plurality of generators for producing an alternating magnetic field, susceptor material which is capable of being heated by said alternating magnetic field and is positioned relative to the generators so as to be heatable by the alternating magnetic field, and a cylindrical cigarette in thermal proximity to the susceptor material, wherein the heating system further comprises:

a cylindrical tube, said tube defined by spaced apart, coaxial inner and outer walls, the inner wall defining a hollow cylindrical receptacle for insertion of the cylindrical cigarette, said plurality of generators located between the spaced apart inner and outer walls.

33. The heating system according to claim 32, wherein each of said plurality of generators comprises a ferrite ring located between the spaced apart inner and outer tube walls and coaxial therewith, and an excitation wire connected to a source of electrical energy wound about each ring to form an excitation coil coaxial with each ring.

34. The heating system according to claim 33, further comprising a plurality of magnetic shield rings, each magnetic shield ring interposed between two adjacent ferrite rings and associated excitation coils, said magnetic shield rings coaxial with said ferrite rings.

35. The heating system according to claim 34, wherein the susceptor material is in intimate physical contact with the cylindrical cigarette, whereby the alternating magnetic field inductively heats said susceptor which in turn heats the tobacco flavor medium of the cylindrical cigarette.

36. The heating system according to claim 35, wherein said susceptor material is aluminum, conductive carbon, graphite, stainless steel, copper, bronze or a combination thereof.

37. The heating system according to claim 33, further comprising a plurality of magnetic shield rings, each magnetic shield ring interposed between two adjacent ferrite rings and associated excitation coils, said magnetic shield rings coaxial with said ferrite rings.

38. The heating system according to claim 33, wherein at least one portion of the susceptor material is in intimate contact with the cylindrical cigarette, whereby the alternating magnetic field inductively heats said susceptor element which in turn heats the tobacco flavor medium of the cylindrical cigarette.

39. The heating system according to claim 38, said susceptor material is aluminum, conductive carbon, graphite, stainless steel, copper, bronze or a combination thereof.

40. The heating system according to claim 33, wherein the inner tubular wall is magnetically permeable.

41. The heating system according to claim 33, wherein the outer tubular wall is a magnetic shield.

42. The heating system according to claim 32, wherein said susceptor material is aluminum, conductive carbon, graphite, stainless steel, copper, bronze or a combination thereof.

* * * * *